US007024994B2

(12) United States Patent
Dour

(10) Patent No.: US 7,024,994 B2
(45) Date of Patent: Apr. 11, 2006

(54) HAND STAMP WITH LOCKING RIBS

(75) Inventor: Frederick W. Dour, Basking Ridge, NJ (US)

(73) Assignee: M&R Marking Systems, Inc., Piscataway, NJ (US)

( * ) Notice: Subject to any disclaimer, the term of this patent is extended or adjusted under 35 U.S.C. 154(b) by 65 days.

(21) Appl. No.: 10/660,971

(22) Filed: Sep. 12, 2003

(65) Prior Publication Data

US 2005/0056173 A1 Mar. 17, 2005

(51) Int. Cl.
*B41D 7/00* (2006.01)

(52) U.S. Cl. ..... 101/333; 101/334; 101/104; 101/105

(58) Field of Classification Search ..... 101/333.334, 101/104, 105

See application file for complete search history.

(56) References Cited

U.S. PATENT DOCUMENTS

| | | | | |
|---|---|---|---|---|
| 5,623,875 | A * | 4/1997 | Perets | 101/334 |
| 5,653,168 | A * | 8/1997 | Shu | 101/333 |
| 5,996,493 | A * | 12/1999 | Okumura et al. | 101/333 |
| 6,302,022 | B1 * | 10/2001 | Shih | 101/379 |
| 6,637,332 | B1 * | 10/2003 | Takami | 101/405 |
| 6,708,613 | B1 * | 3/2004 | Faber | 101/333 |

FOREIGN PATENT DOCUMENTS

WO WO 01/85462 A1 * 11/2001

* cited by examiner

*Primary Examiner*—Ren Yan
*Assistant Examiner*—Andrea H. Evans
(74) *Attorney, Agent, or Firm*—Lerner, David, Littenberg, Krumholz & Mentlik, LLP

(57) ABSTRACT

A hand stamp is disclosed. The hand stamp comprises a frame including dove-tailed ribs which flare outwardly along at least one side thereof. The dove-tailed ribs of the frame are arranged within corresponding shaped grooves of a case, thus obtaining secure mounting of the case on the frame while facilitating relative slidable movement therebetween.

23 Claims, 9 Drawing Sheets

HAND STAMP WITH LOCKING RIBS

FIELD OF THE INVENTION

The present invention relates to hand stamps. More particularly, the present invention relates to hand stamps including a case securely mounted to a corresponding frame.

BACKGROUND OF THE INVENTION

Round hand stamps have been commercially available for many years. Such round hand stamps typically include a generally cylindrical configuration. Such hand stamps may be of the self-inking or pre-inked typed.

Self-inking hand stamps typically include an invertible stamp carrying platen and ink pad arranged within a frame. The platen may be connected to an impressible case which is slidably mounted on the frame.

The marking structure (i.e., the actual stamping member) of self-inking hand stamps are made of rubber or the like. They must be placed in contact with a source of ink, such as an internal ink pad, when the hand stamp is in a rest position. The ink pad may be permanently arranged within the hand stamp or may be removable.

Rubber marking structures used in self-inking hand stamps have a printing surface, which is typically arranged in contact with the ink pad when the hand stamp is in a rest position. The printing face of the marking structure is then typically moved and inverted along with a platen on which it is mounted through 180 degrees until it comes into contact with the desired surface to be printed—i.e., when the hand stamp is depressed into a printing position.

One brand of high-quality self-inking hand stamps is manufactured and sold by M&R Marking Systems, Inc. under the trademark IDEAL®. Such self-inking hand stamps are discussed in prior art patents owned by M&R Marking Systems, Inc. including U.S. Pat. Nos. 5,649,485; 4,852,489; and 4,432,281.

The self-inking hand stamps disclosed in the '485, '489 and '281 patents have provided important commercial improvements in the hand stamp industry. Such improvements include, for example, a removable ink pad holder having re-inking ports on the back thereof; the ability to quickly and neatly replenish the ink supply of an associated ink pad; the ability to grasp the hand stamp from any direction; and advantages relating to displaying indicia information to be imprinted by the hand stamp.

While the foregoing self-inking hand stamps have been commercially successful and provided significant advantages, a need still exists for further improvements in self-inking and pre-inked hand stamp devices.

Pre-inked hand stamps include microporous marking structures, which are typically made of various polymeric materials and resin. These materials may comprise thermoplastic resin or other open cell compositions, such as specially formulated foam having a large quantity of microscopic pores. The microporous marking structure may be impregnated with ink or other suitable marking fluid during the manufacturing process or after it is manufactured.

Pre-inked hand stamps differ from self-inking hand stamps in that they do not need to include a separate ink pad as a source of marking fluid. Thus, pre-inked hand stamps can be used to create numerous ink impressions without requiring the user to introduce additional ink into the marking structure. This is possible due to the microscopic size of the pores, which allow the ink initially retained therein to escape at a controlled rate.

One brand of high-quality pre-inked hand stamps is manufactured and sold by M&R Marking Systems, Inc. under the trademark ROYAL MARK®. These pre-inked marking structures are made from ROYAL MARK® brand gel, which comprises a mixture of thermoplastic resin and ink. Another well known brand of high-quality pre-inked hand stamps is marketed by M&R Marking Systems, Ink under the trademark OPTIMARK®. The OPTIMARK® brand hand stamps include a microporous foam material as the marking structure.

Yet another brand of high-quality pre-inking hand stamps is manufactured and sold by M&R Marking Systems, Inc. under the trademark ULTIMARK®. The ULTIMARK® brand hand stamps includes a microporous foam material, which has been impregnated with ink during the manufacturing process, as the marking structure.

Self-inking and pre-inked hand stamps exist in many geometric shapes and sizes. For some applications, it is desirable for the hand stamps to have a generally cylindrical configuration. Such cylindrical hand stamps are known as round hand stamps. When the round hand stamps are self-inking stamps, they are known are known round self-inkers.

Efforts have been made in designing round self-inkers to securely mount the case of the hand stamp to the frame. Typically, the platen is also secured to the case and is movable along with the marking structure secured thereon from a rest position, where the marking structure is in contact with an internal ink pad, to a printing position where the face of the marking structure becomes inverted and contacts the desired surface to be imprinted.

It is important in round self-inkers to secure the case to the frame such that the case will not become dislodged in the event that the hand stamp is accidentally dropped or a twisting force is applied when the hand stamp is operated. To meet this need, it is known for the case of the hand stamp to include ribs and the frame of the hand stamp to include cooperating grooves (e.g., slots) in which the ribs are arranged. In such an embodiment, the case is free to slide longitudinally along the frame as it is depressed during operation of the hand stamp. While it is desirable for the case to be fully slidable in the longitudinal direction (i.e., typically in the vertical direction), it is undesirable for the construction of the hand stamp to be such that the case can easily become dislodged if a twisting force is applied to it.

Round pre-inked hand stamps may have the same problems, but typically secure the case to the frame in a different manner as it is not necessary for the marking structure to have the same degree of movement and inversion as is the case in self-inking hand stamps.

SUMMARY OF THE INVENTION

The present invention overcomes shortcomings in the structure of prior art hand stamps. In accordance with a preferred embodiment of the present invention, a hand stamp comprises a frame, a case slidably mounted on the frame, a platen arranged for slidable movement with the case along the frame and an impression member arranged on the platen. As used herein the term "marking structure" should be construed broadly to comprise any suitable marking structure made of a natural or synthetic material used for self-inking or pre-inked hand stamps. For example, rubber marking structures are typically used with self-inking stamps such as the self-inking stamp shown in the drawings and described below in the preferred embodiments of the present invention. Microporous marking structures are typically used for pre-inked stamps.

The frame includes one or more dove-tailed ribs thereon while the case includes sized and shaped grooves corresponding with the dove-tailed ribs to facilitate secure mounting of the case to the frame while permitting slidable longitudinal movement therealong. As used herein, the term "dove-tailed ribs" shall mean ribs having at least one side that flares outwardly. The outward flaring of the ribs and the corresponding sized and shaped grooves in which the ribs are arranged can be more fully understood when considered in view of the drawings and the detailed description of the preferred embodiments set forth below.

The frame preferably includes at least a first rib longitudinally arranged thereon. The first rib may be molded to the frame and preferably includes at least one side, which flares outwardly from the frame. In this preferred embodiment, the case preferably includes at least a first groove and the first rib is arranged therein. The first groove and the first rib are sized and shaped to facilitate slidably longitudinal movement of the case along the frame, while obtaining secure mounting of the case on the frame. The platen is preferably arranged for slidable movement along with the case on the frame. A marking structure is arranged on the platen and is movable therewith between a rest position and a printing position.

The frame of the hand stamp preferably comprises a second rib longitudinally arranged thereon. Like the first rib, the second rib may be molded to the frame and is preferably dove-tailed. In this preferred embodiment, the case comprises a second groove in which the second rib is arranged. The second groove and the second rib are sized and shaped to facilitate slidable longitudinal movement of the case on the frame while securely mounting the case on the frame.

In an alternate embodiment, the first and second ribs may have different lengths. In particular, the length of the first rib may be greater than the length of the second rib or vice versa.

Preferably, the frame comprises opposing sides and one set of first and second ribs are arranged on each of the opposing sides. It is also preferable for the first and second ribs on each of the sides of the frame to have substantially the same length, although different length ribs can be provided as in the alternate embodiment discussed above.

The first set of first and second ribs are preferably arranged on one of the opposing sides of the frame while the second set of first and second ribs are arranged on the other of the opposing sides. In this preferred embodiment, the case comprises two sets of first and second grooves in which corresponding ones of the first and second ribs are arranged.

In the preferred embodiment where the frame comprises opposing sides and one set of first and second ribs are arranged on each of the opposing sides, the first and second ribs of one set preferably extend in the same plane as each other, while the first and second ribs of the other set will also extend in the same plane as each other.

It is preferable for the case to comprise a generally cylindrical configuration. However, in alternate embodiments, the geometric configuration of the case and the frame on which it is mounted may vary.

In a preferred embodiment, the marking structure comprises a rubber marking structure. The hand stamp may also comprise an ink pad against which the rubber marking structure is arranged when in its rest position. The rubber marking structure is then moved from the ink pad into contact with the surface to be imprinted when in its printing position. Thus, in such preferred embodiment, the hand stamp is a self-inking hand stamp.

In an alternate embodiment, the marking structure comprises a microporous marking structure such that the hand stamp is a pre-inked hand stamp.

It is also preferable for the hand stamp to comprise a locking mechanism operative to selectively lock the case in a desired position relative to the frame. The desired locked position may be one in which the ink pad of the hand stamp may be removed from assembled position and either re-inked or replaced.

In an alternate embodiment of the present invention, the location of the dovetailed ribs and corresponding grooves on the frame and the case of hand stamp may be reversed. Thus, in such alternate embodiment, the dovetailed ribs may be arranged on the case and the corresponding shaped grooves may be arranged on the frame of the hand stamp.

The above features and advantages of the present hand stamp will be more fully appreciated when considered in view of the following detailed description of the preferred embodiments and accompanying drawings.

DETAILED DESCRIPTION

Preferred embodiments of the hand stamp 10 in accordance with the present invention is shown in FIGS. 1–11. The hand stamp 10 is shown as a self-inking hand stamp. However, the present invention also applies to pre-inking hand stamps and thus, the description of the preferred embodiments herein is not intended to limit the scope of the present invention to self-inking hand stamps.

The hand stamp 10 includes a frame 12 as shown in FIGS. 1–5 and 7–9. The frame 12 has a bottom end 14 and a top end 16. When assembled, the top end 16 of the frame 12 cannot be seen. However, top end 16 is visible in FIG. 5, which illustrates an isolated perspective view of the frame 12.

Figure 1:
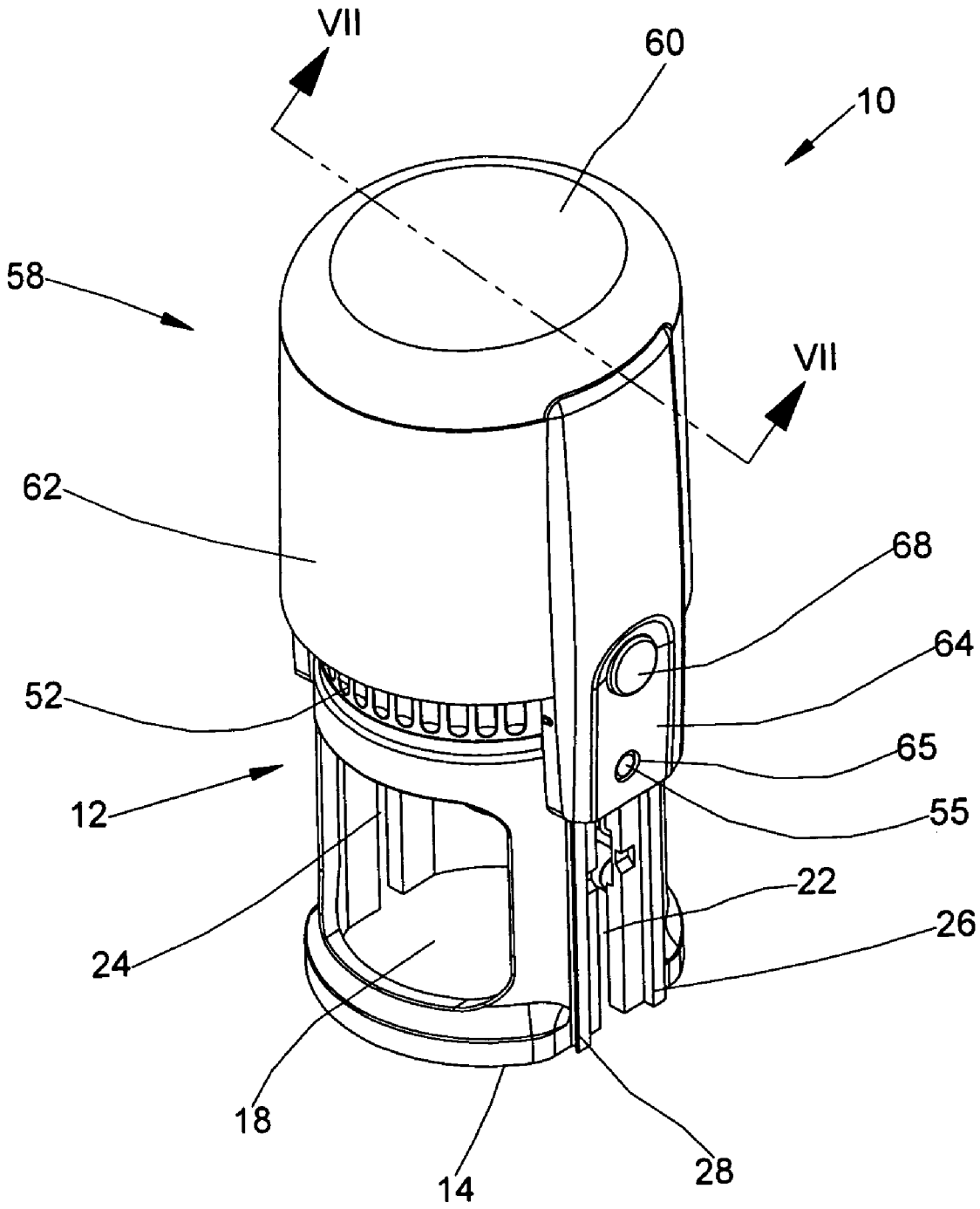
FIG. 1 is a perspective view of a preferred embodiment of a hand stamp in assembled position.
Figure 2:
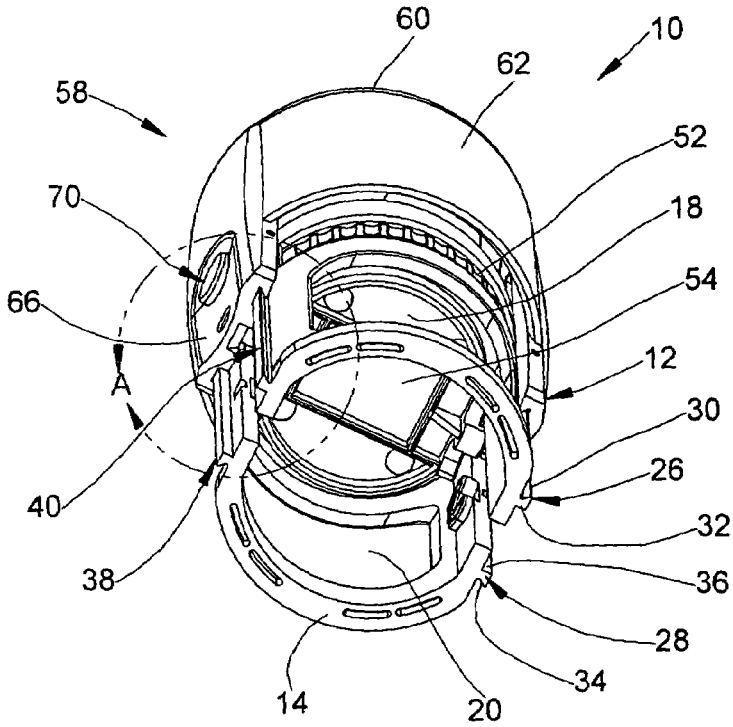
FIG. 2 is the bottom perspective view of the hand stamp of FIG. 1.
Figure 3:
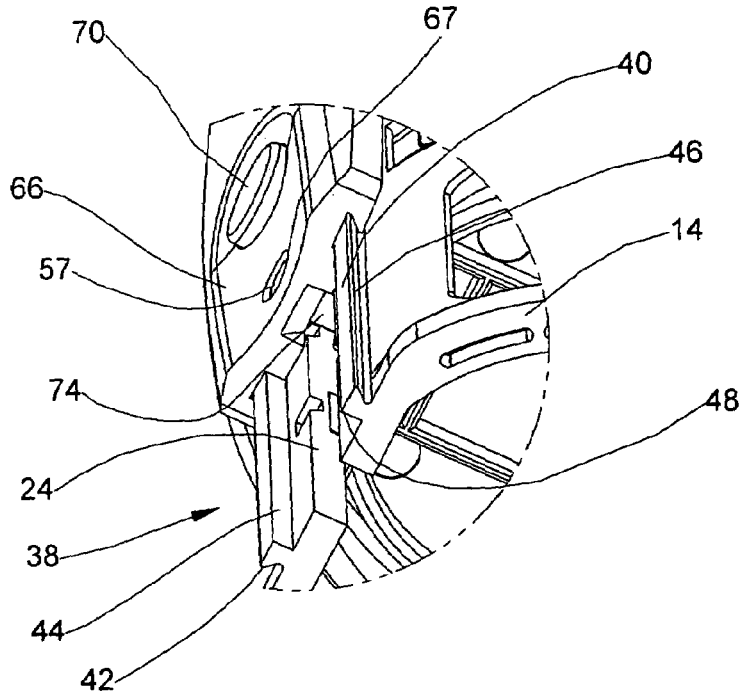
FIG. 3 is an enlarged perspective view of the area designated Detail A in FIG. 2, showing the connection between the frame and case of the present hand stamp.
Figure 4:
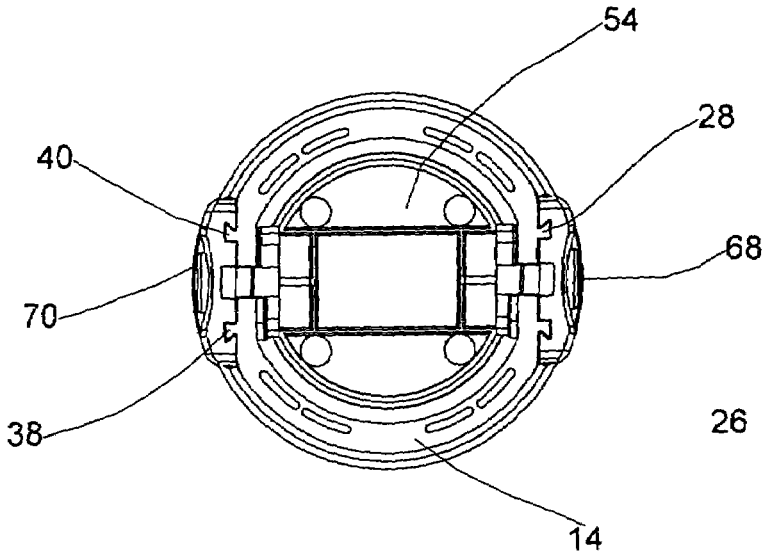
FIG. 4 is a bottom plan view of the hand stamp of FIG. 1.
Figure 5:
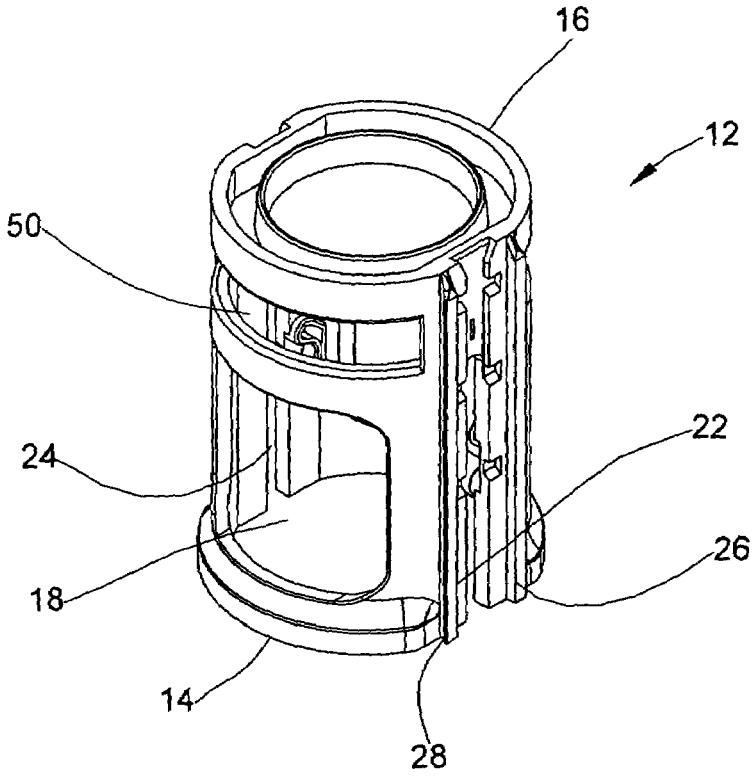
FIG. 5 is a perspective side view of the frame component of the hand stamp shown in FIG. 1.
Figure 6:
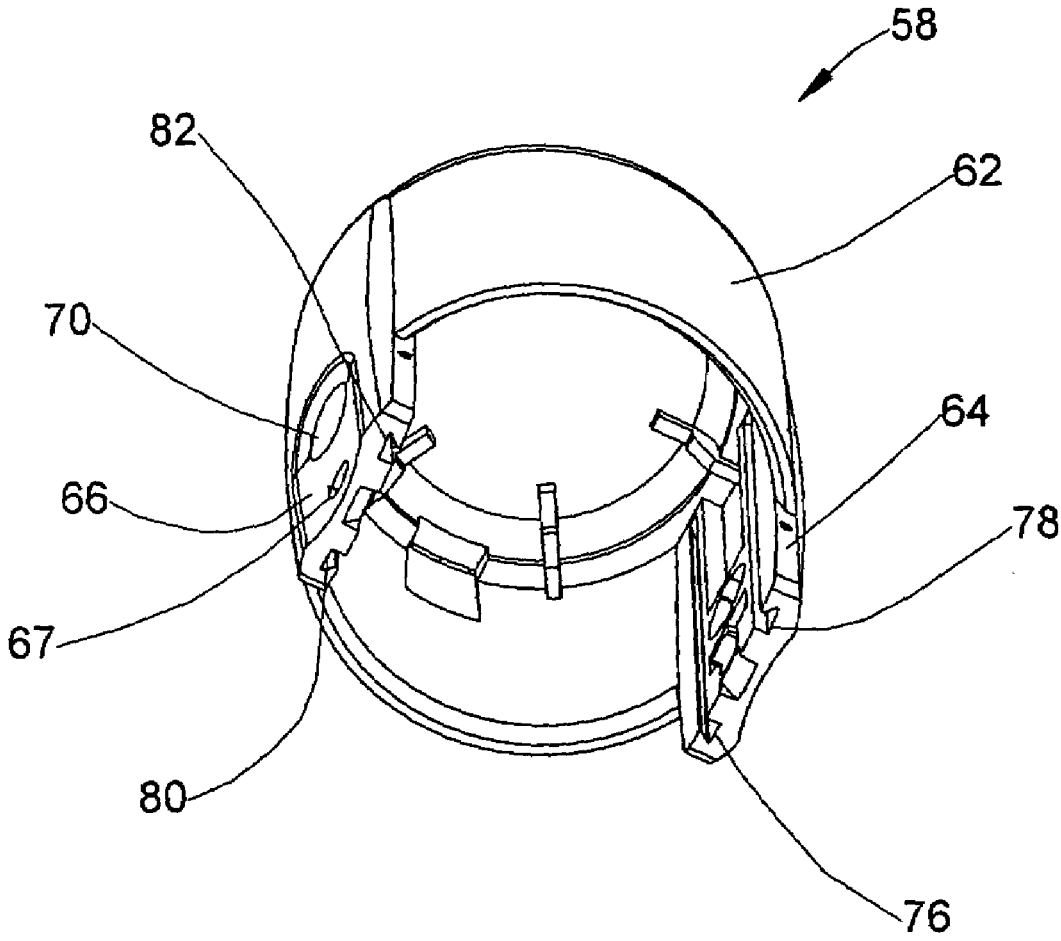
FIG. 6 is a perspective bottom view of the case component of the hand stamp of FIG. 1.
Figure 7:
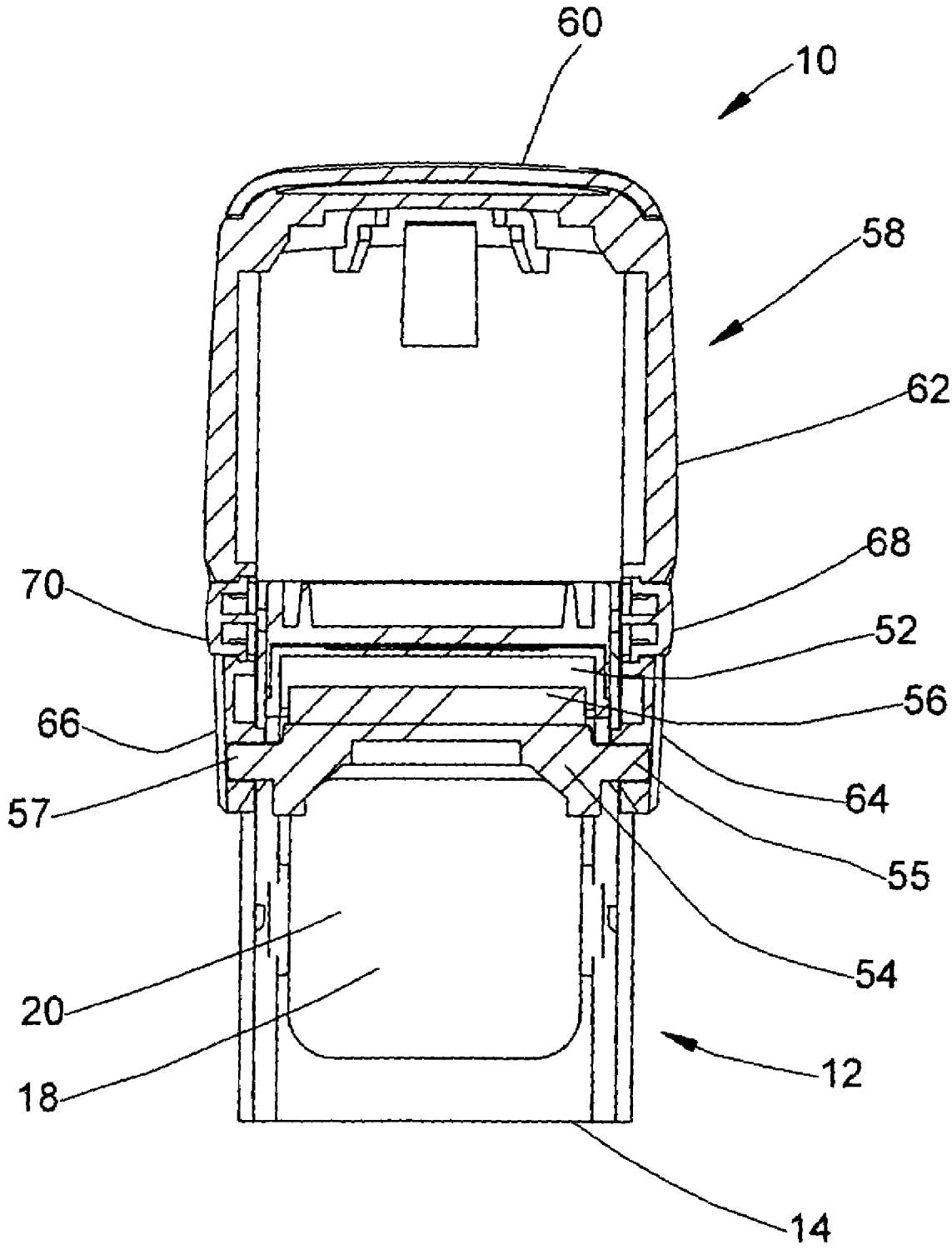
FIG. 7 is cross sectional view of the present hand stamp shown in its rest position taken along line VII—VII of FIG. 1.

As best shown in FIGS. 1 and 7, the frame 12 includes an opening 18 which extends through the front face thereof and an aligned opening 20, which extends through the rear face thereof. In alternate embodiments, the front and rear faces of the frame may be solid.

Right and left side slots 22 and 24 are shown in FIGS. 1–5 and 7. The slots 22 and 24 are sized and shaped to receive corresponding posts extending outwardly from opposing sides of a platen 54 and cooperating runners of a case 58 as discussed below.

A significant aspect of the present hand stamp 10 relates to the geometric configuration of ribs arranged on the frame 12 within cooperating grooves arranged in the case 58. In particular, the frame 12 includes a pair of ribs 26 and 28 extending parallel to each other on the right side thereof. These ribs may be considered first and second ribs, respectively on the right side of the frame 12. In the preferred embodiment described herein and shown in FIGS. 1–8, the first and second ribs 26 and 28 are identical to each other in both length and geometrical configuration.

Figure 9:
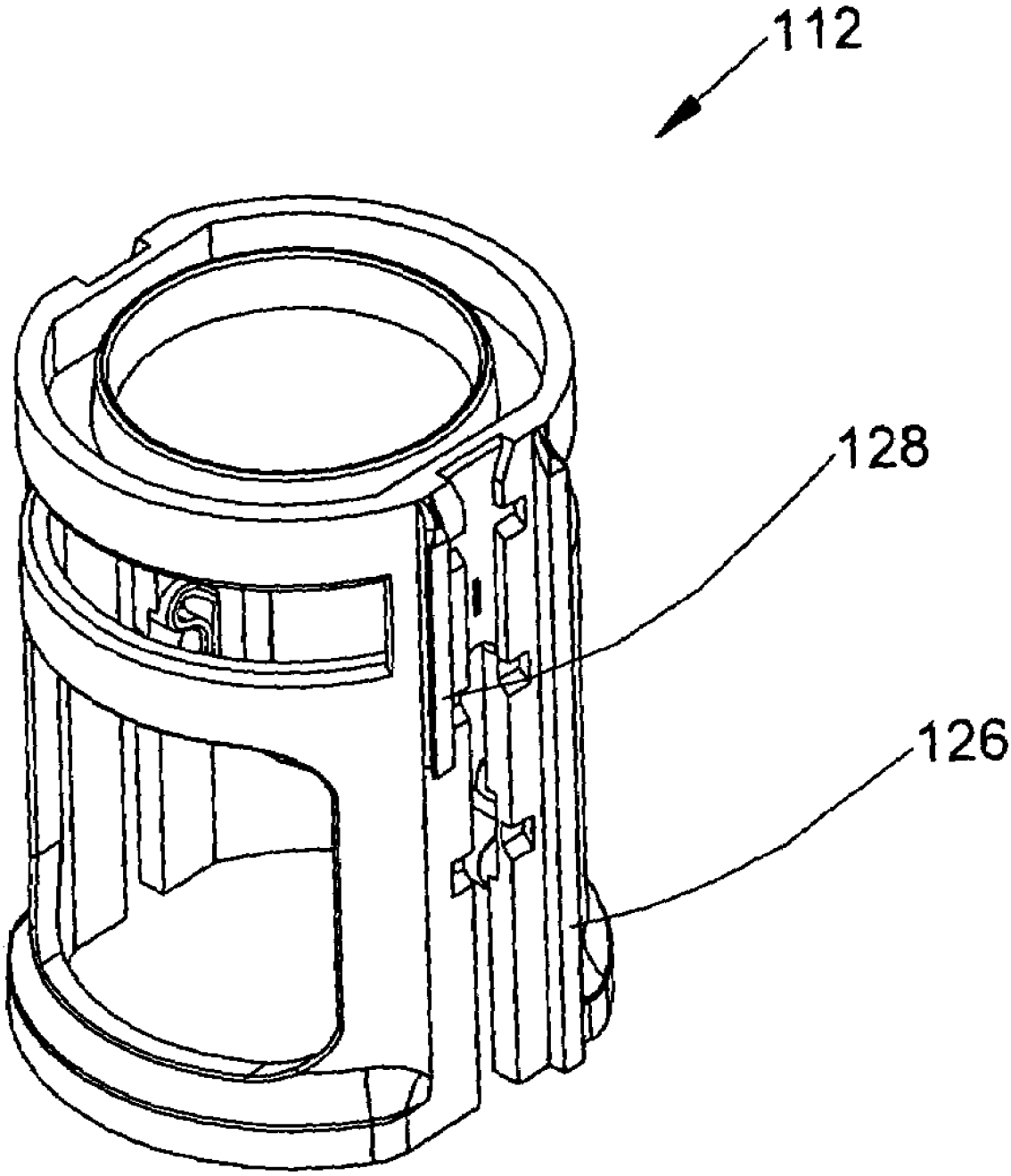
FIG. 9 is a bottom perspective view of an alternate embodiment of the frame of the present hand stamp showing ribs of different lengths.

In an alternate embodiment, the geometric configuration and length of the ribs need not be identical. For example FIG. 9 shows an alternate embodiment including frame 112 where each side includes opposing ribs 126 and 128 having different lengths. A significant aspect of ribs 26 and 28 is that they are dove-tailed (i.e., flared out) on at least one side thereof. For example, rib 26 is dove-tailed as indicated by reference numeral 30 on one side thereof. The other side of rib 26 is substantially flat as indicated by reference numeral 32. Similarly, rib 28 is dove-tailed such that it is flared out on one side as indicated by reference numeral 34, but the other side 36 is flat.

The left side of frame 12 is substantially identical to the right side as it includes a pair of identical ribs 38 and 40. First left side rib 38 is dove-tailed as indicated at 42 and is flat as indicated at 44. Similarly, the second left side rib 40 is also dove-tailed as shown at 46 and is flat as shown at 48.

The dove-tailed feature of the pairs of ribs 26, 28 and 38, 40 provides structural integrity to retain the case 58 in a secured position on the frame 12 while facilitating longitudinally slidable movement between the case 58 and frame 12.

Figure 8:
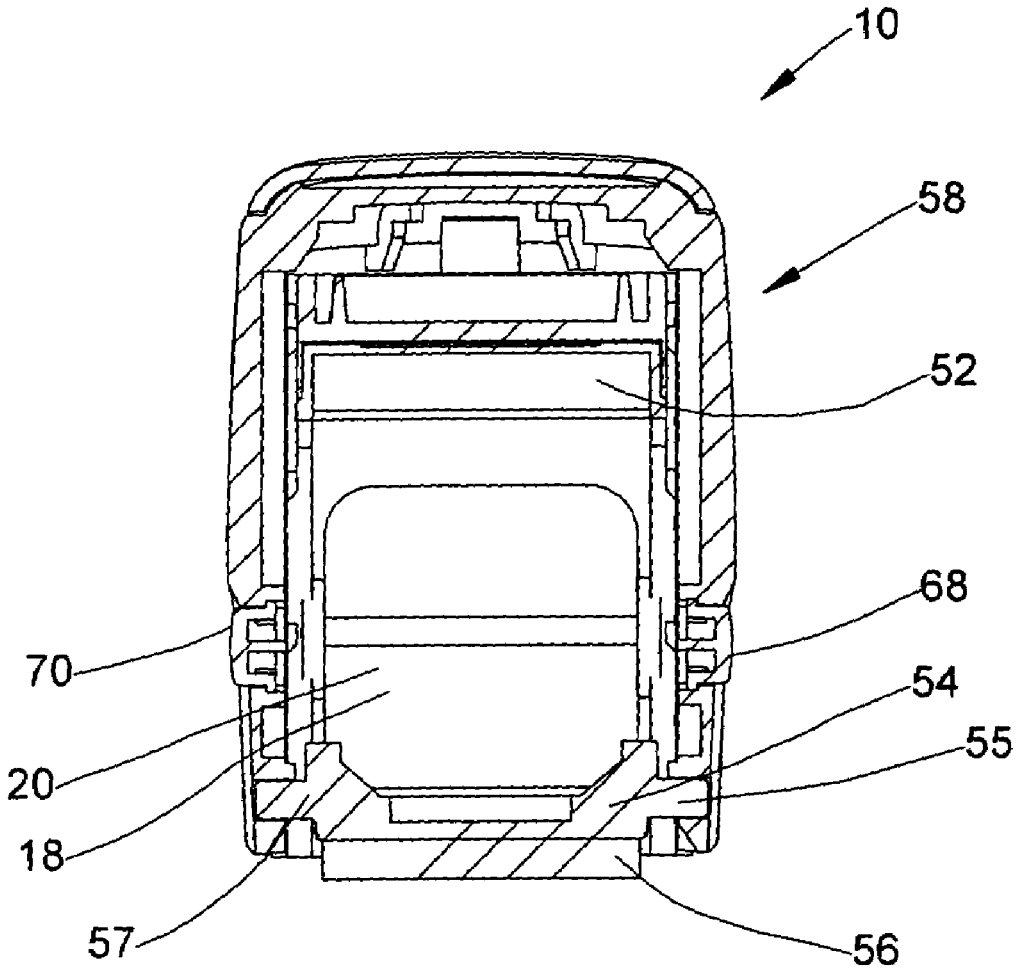
FIG. 8 is a cross sectional view of the hand stamp of the present invention shown in a fully compressed printing position.

The frame 12 also includes an opening 50 for insertion and removal of a corresponding inkwell 52 as shown in FIGS. 7–8. The platen 54 and corresponding rubber marking structure 56 are also shown in the cross sectional views of FIGS. 7–8.

Another significant aspect of the present hand stamp 10, includes features of the case 58, which is securely mounted for slidable movement on the frame 12. As shown in FIGS. 1 and 7–8, the case 58 includes a generally cylindrical body 62 and a circular top 60. The case 58 also includes a right side extension arm 64 and a left side extension arm 66, which oppose each other and extend downwardly along the associated frame 12.

A pair of locking buttons 68 and 70 are arranged at respective right and left sides of the case 58 as shown in FIGS. 1–4, 6 and 7. The locking buttons 68 and 70 allow a user to selectively lock the case in certain positions with respect to the frame 12 to permit removal of the inkwell 52 for re-inking or to retain the case in a depressed position for storage. Alternate embodiments of the invention may include only a single locking button or may not include any locking button.

The right side extension arm 64 includes a central runner 72, which extends into the right side slot 22 of frame 12. Similarly, the left side extension arm 60 of case 58 includes a central runner 74, which is arranged within left side slot 24 of frame 12. The runners 72 and 74 may be eliminated in alternate embodiments of the invention.

A significant aspect of the present invention relates to the size and shape of grooves 76, 78, 80 and 82 arranged within the right and left side extension arms 64 and 66 of case 58. More particularly, a first pair of grooves 76 and 78 are clearly shown in FIGS. 2–4, 6 and 7 as having a substantially flat side and an outwardly flared side to accommodate the dove-tailed shape of corresponding first and second ribs 26 and 28. As the case 58 is symmetrical, the left side extension arm 66 includes corresponding grooves 80 and 82, which also are flared at one side and flat at the other to cooperate with the size and shape of corresponding ribs 38 and 40.

When the hand stamp 10 is fully assembled such that the case 58 and frame 12 are connected, the dove-tailed ribs 24, 26, 38 and 40 are arranged within corresponding grooves 76, 78, 80 and 82 to facilitate slidable movement of the case 58 along the frame 12. This will permit a user to operate the hand stamp 10 when it is desired to create an ink impression upon movement of the marking structure 56 from its rest position, where its face is in contact with inkwell 52 to its printing position where its face contacts a surface and imprints an ink design thereon.

The dove-tailed configuration of ribs 26, 28, 38 and 40 and cooperating flared grooves 76, 78, 80 and 82 provide structural integrity by securely mounting the case 58 to the frame 12. Thus, the combination of the ribs and grooves serve to prevent the case 58 from being removed from the frame 12 in the event that the case 58 is inadvertently twisted or in situations where the hand stamp 10 is dropped.

FIG. 7 shows a cross sectional view of hand stamp 10 taken along line VII—VII of FIG. 1. This cross sectional view is indicative of hand stamp 10 when arranged in a rest position and thus, the face of the marking structure 56 is retained in contact with the inkwell 52 within the frame 12. Further, the platen 54 is shown to be connected to frame 12 via opposing posts 55, which extend through apertures 65 and 67 arranged through right and left extension arms 64 and 66, respectively.

FIG. 8 is a cross sectional view of the hand stamp 10, illustrating the hand stamp 10 when compressed into its printing position such that the face of marking structure 56 is in contact with the surface of an object to be imprinted with the desired ink design.

Figure 10:
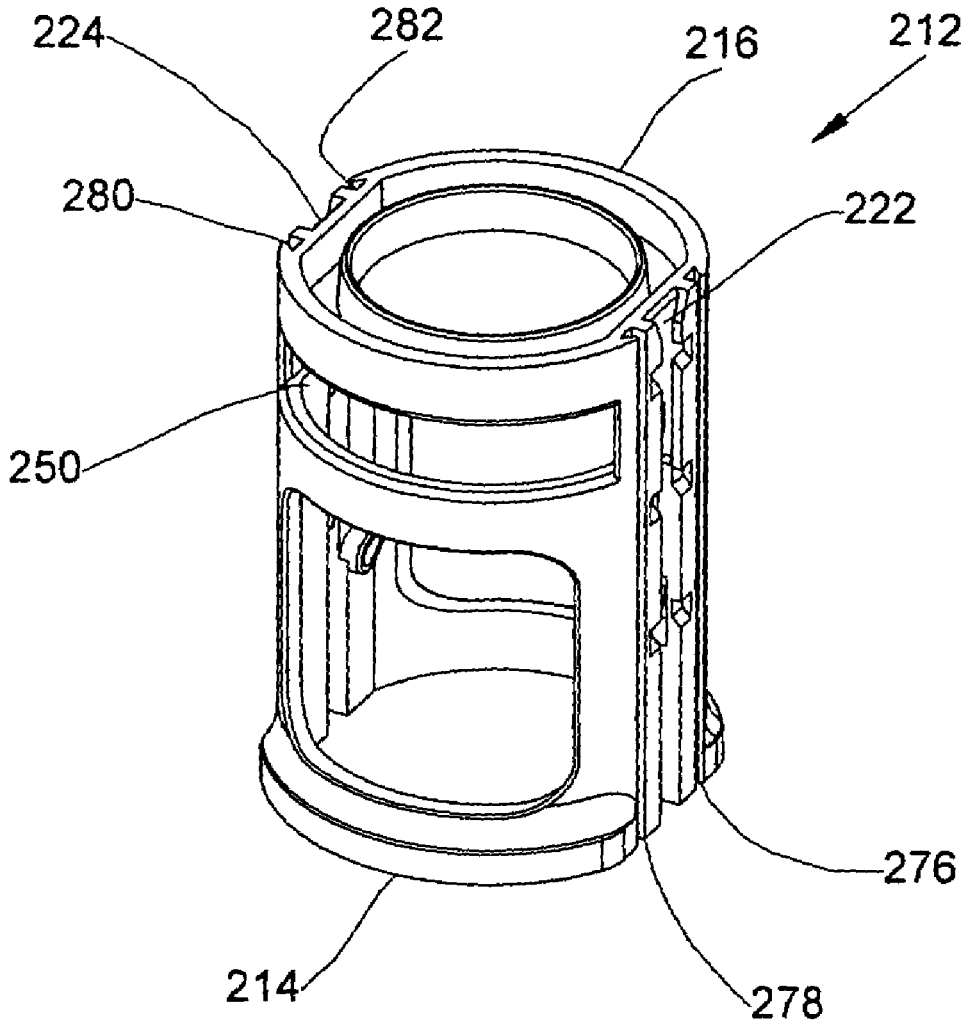
FIG. 10 is a perspective side view of a frame in accordance with an alternate embodiment of the present hand stamp.
Figure 11:
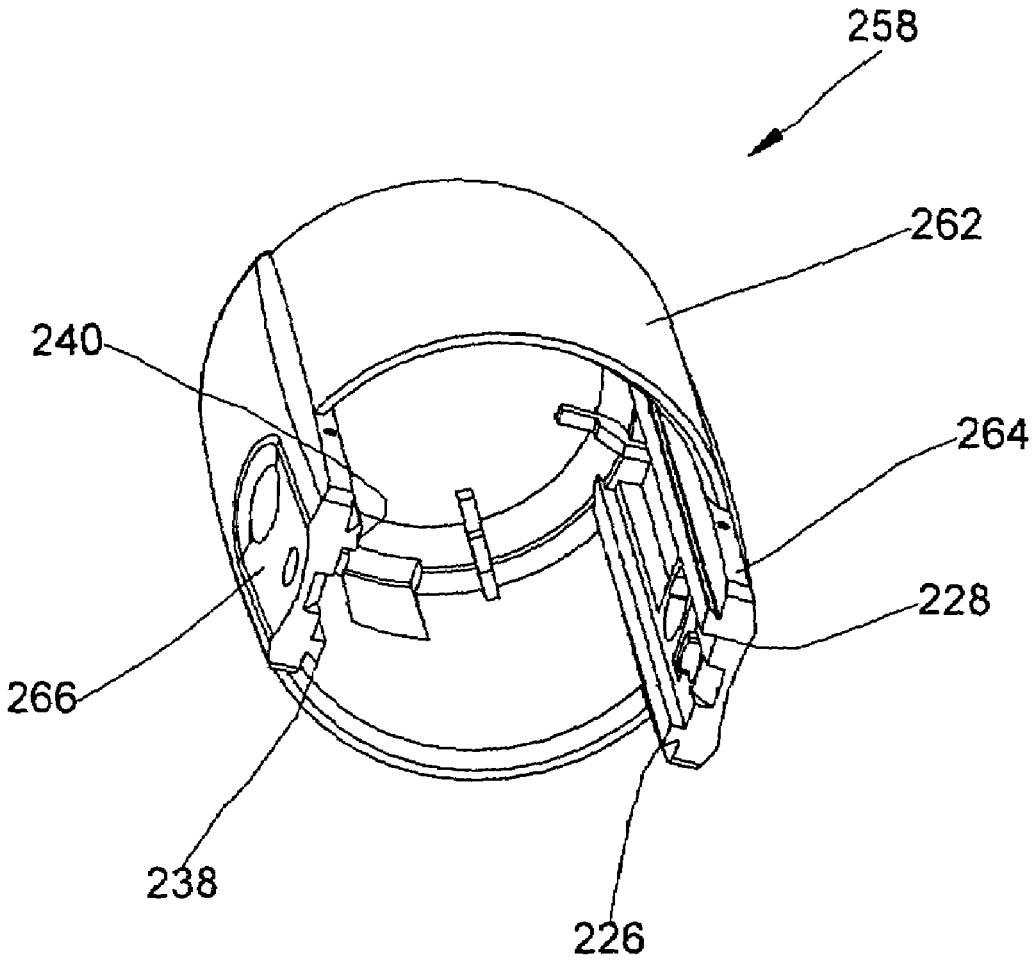
FIG. 11 is a perspective bottom view of a case corresponding with the frame of FIG. 10.

An alternate embodiment of the present invention reverses the location of the dovetailed ribs and corresponding grooves on the frame and case of the hand stamp. FIGS. 10 and 11 illustrate such alternate embodiment where the dovetailed ribs are arranged on the case and the corresponding shaped grooves are arranged on the frame.

FIG. 10 illustrates a perspective view of a frame 212 having two sets of grooves 276, 278 and 280, 282 arranged on the right and left sides, respectively. The size and shape of grooves 276, 278, 280 and 282 correspond closely with the size and shape of dovetailed ribs arranged on the case 258 illustrated in FIG. 11. Centrally arranged slots 222 and 224 are illustrated on the right and left sides of frame 212. As also shown in FIG. 10, frame 212 includes a top end 216, a bottom end 214 and an opening for an inkwell 250.

FIG. 11 illustrates that a case 258 includes two so sets of dovetailed ribs, 226, 228 and 238, 240 arranged on the right and left sides, respectively. The other features of the case 258 are identical to the features of the case 58 shown in FIG. 6. Thus, case 258 includes right and left side extension arms 264 and 266. The case 258 includes a generally symmetrical cylindrical body 262. The pairs of dovetailed ribs 226, 228 and 238, 240 are sized and shaped to be mounted within corresponding grooves 276, 278 and 280, 282 such that the case 258 is securely mounted on the frame 212 for slidable movement in substantially the same manner as the corresponding case 58 and frame 12 of FIGS. 1–8.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention of claimed is:

1. A hand stamp comprising:

a frame including a first rib longitudinally arranged thereon, said first rib being integral with said frame and flaring outwardly therefrom such that said first rib has a relatively small width at a location adjacent to said frame and a relatively large width at a location remote from said frame;

a case slidably mounted on said frame, said case including a first groove oppositely flared with respect to said first rib to conform with the flared configuration thereof, said first rib and said first groove being sized and shaped to facilitate relative longitudinal movement and secure mounting of said case on said frame in a transverse direction with respect to said longitudinal movement;

a platen arranged for movement with said case along said frame; and a marking structure arranged on said platen and being movable therewith between a rest position and a printing position.

2. The hand stamp of claim 1, wherein said frame further comprises a second rib longitudinally arranged thereon, said second rib being integral with said frame and flaring outwardly therefrom, said case further comprising a second groove, said second rib being arranged within said second groove, said second rib and said second groove being sized and shaped identical to the first rib and the first groove.

3. The hand stamp of claim 2, wherein said first rib comprises a first length and said second rib comprises a second length, said first length being greater than said second length.

4. The hand stamp of claim 3, wherein said frame comprises opposing sides and two sets of first and second ribs, the first set of said first and second ribs being arranged on one of said opposing sides, and the second set of said first and second ribs being arranged on the other of said opposing sides; and said case also comprising opposing sides and two sets of first and second grooves wherein said first said of said first and second grooves is arranged on one of said opposing sides, and the second set of said first and second grooves is arranged on the other of said opposing sides, each set of said first and second ribs being arranged within a corresponding one of said sets of said first and second grooves.

5. The hand stamp of claim 4, wherein said first and second sets of said first and second ribs extend parallel to each other.

6. The hand stamp of claim 1, wherein said first rib is molded to said frame.

7. The hand stamp of claim 6, wherein said first rib comprises opposing sides, at least one of said opposing sides flaring outwardly from said frame.

8. The hand stamp of claim 1, wherein said case comprises a generally cylindrical configuration.

9. The hand stamp of claim 1, wherein said marking structure comprises a rubber marking structure.

10. The hand stamp of claim 1, further comprising an ink pad arranged within said case, said marking structure being movable between said rest position where it is in contact with said ink pad and said printing position where it is remote from said ink pad and in contact with a surface to be imprinted.

11. The hand stamp of claim 1 further comprising a locking mechanism operative to selectively lock said case in a desire position relative to said frame.

12. The hand stamp of claim 4, wherein said frame has a bottom end adapted to be placed adjacent to a surface to be imprinted, and a top end remote from said bottom end and a length defined by the distance between said top and bottom ends, each of said first ribs extending longitudinally along substantially the entire length of said frame on opposing sides thereof.

13. A hand stamp comprising:

a frame including opposing sides, a bottom end adapted to be placed adjacent to a surface to be imprinted and a top end remote from said bottom end, and a length defined by the distance between said top and bottom ends, a pair of first ribs, one of said first ribs arranged on one of said opposing sides and the other of said first ribs arranged on the other of said opposing sides, each of said pair of opposing ribs flaring outwardly from said frame such that said first ribs have a relatively small width at a location adjacent said frame and a relatively large width at a location remote from said frame;

a case slidably mounted on said frame, said case including a pair of first grooves oppositely flared with respect to said first ribs to conform with the flared configuration thereof, said pair of first ribs being arranged within respective ones of said pair of first grooves, said pair of first ribs and said pair of first grooves being sized and shaped to facilitate slidable longitudinal movement and secure mounting of said case on said frame in a transverse direction with respect to said longitudinal movement;

a platen arranged for movement with said case along said frame; and a marking structure arranged on said platen and being movable therewith between a rest position and a printing position.

14. The hand stamp of claim 13, wherein said frame further comprises a pair of second ribs arranged on respective ones of said opposing sides of said frame, each of said second ribs flaring outwardly from said frame, said case further comprising a pair of second grooves, one of said second ribs being arranged within one of said second grooves, and the other said second ribs being arranged within the other of said second grooves, each of said second ribs and said second grooves being sized and shaped identical to the first ribs and the first grooves.

15. The hand stamp of claim 14, wherein each of said first ribs comprises a first length and each of said second ribs comprise a second length, said first length being greater than said second length.

16. The hand stamp of claim 15, wherein said pairs of said first and second ribs are molded to said frame.

17. The hand stamp of claim 13, wherein said case comprises a generally cylindrical configuration.

18. The hand stamp of claim 13, wherein said marking structure comprises a rubber marking structure.

19. The hand stamp of claim 13 further comprising an ink pad arranged within said case, said marking structure being movable between said rest position where it is in contact with said ink pad and said printing position where it is remote from said ink pad and in contact with a surface to be imprinted.

20. The hand stamp of claim 14, wherein said opposing pairs of said first and second ribs extend longitudinally along substantially the entire length of said frame on opposing sides thereof.

21. A hand stamp comprising:

a frame including at least one groove extending longitudinally thereon;

a case slidably mounted on the frame, said case including at least one rib extending longitudinally thereon, said at least one rib being integral with said case and flaring outwardly therefrom such that said at least one rib has a relatively small width at a location adjacent said case and a relatively larger width at a location remote from said case, said at least one groove being oppositely flared with respect to said at least one rib to conform with the flared configuration thereof, said at least one rib and said at least one groove being sized and shaped to facilitate relative longitudinal movement and secure mounting said case on said frame in a transverse direction with respect to said longitudinal movement;

a platen arranged for movement with said case along said frame; and a marking structure arranged on said platen and being movable therewith between a rest position and a printing position.

22. A hand stamp comprising:

a frame including a first groove longitudinally arranged thereon;

a case slidably mounted on said frame, said case including a first rib longitudinally arranged thereon, said first rib being integral with said frame and flaring outwardly therefrom such that said first rib has relatively small width at a location adjacent said case and a relatively large width at a location remote from said case, said first groove being oppositely flared with respect to said first rib to conform with the flared configuration thereof, said case being slidably mounted on said frame, said first rib and said first grove being sized and shaped to facilitate longitudinal movement and secure mounting of said case on said frame in a transverse direction with respect to said longitudinal movement;

a platen arranged for movement with said case along said frame; and a marking structure arranged on said platen and being movable therewith between a rest position and a printing position.

23. The hand stamp of claim 22 wherein said case further comprises a second rib longitudinally arranged thereon, said second rib being integral with said case and flaring outwardly therefrom, said frame further comprising a second groove longitudinally arranged thereon, said second rib being arranged within said second groove, said second rib and said second groove being sized and shaped identical to the first rib and the first groove.

* * * * *

UNITED STATES PATENT AND TRADEMARK OFFICE

CERTIFICATE OF CORRECTION

PATENT NO. : 7,024,994 B2 
APPLICATION NO. : 10/660971
DATED : April 11, 2006
INVENTOR(S) : Frederick W. Dour It is certified that error appears in the above-identified patent and that said Letters Patent is hereby corrected as shown below:

Column 2, line 14, "includes" should read --include--
Column 2, line 22, "are known" should read --as--
Column 3, line 38, "are arranged" should read --is arranged--
Column 3, line 43, "are preferably" should read --is preferably--
Column 3, line 46, "are arranged" should read --is arranged--
Column 3, line 51, "are" should read --is--
Column 4, line 54, "is shown" should read --are shown--
Column 5, line 20, "For example" should read --For example,--
Column 5, line 46, "stamp 10," should read --stamp 10--
Column 6, line 28, "serve" should read --serves--
Column 6, line 60, "two so sets" should read --two sets--
Column 7, line 14, "The invention of claimed is:" should read --What is claimed is:--
Column 7, line 52, "first said of" should read --first of--
Column 8, line 52, "other said" should read --other of said--
Column 10, line 13, "grove" should read --grooves--

Signed and Sealed this

Twenty-sixth Day of September, 2006

JON W. DUDAS
*Director of the United States Patent and Trademark Office*

UNITED STATES PATENT AND TRADEMARK OFFICE

CERTIFICATE OF CORRECTION

PATENT NO. : 7,024,994 B2 
APPLICATION NO. : 10/660971
DATED : April 11, 2006
INVENTOR(S) : Frederick W. Dour It is certified that error appears in the above-identified patent and that said Letters Patent is hereby corrected as shown below:

Column 2, line 14, "includes" should read --include--
Column 2, line 22, "are known" should read --as--
Column 3, line 38, "are arranged" should read --is arranged--
Column 3, line 43, "are preferably" should read --is preferably--
Column 3, line 46, "are arranged" should read --is arranged--
Column 3, line 51, "are" should read --is--
Column 4, line 54, "is shown" should read --are shown--
Column 5, line 20, "For example" should read --For example,--
Column 5, line 46, "stamp 10," should read --stamp 10--
Column 6, line 28, "serve" should read --serves--
Column 6, line 60, "two so sets" should read --two sets--
Column 7, line 14, "The invention of claimed is:" should read --What is claimed is:--
Column 7, line 52, "first said of" should read --first of--
Column 8, line 52, "other said" should read --other of said--
Column 10, line 13, "grove" should read --groove--

This certificate supersedes Certificate of Correction issued September 26, 2006.

Signed and Sealed this

Twentieth Day of November, 2007

JON W. DUDAS
*Director of the United States Patent and Trademark Office*